US005083139A

United States Patent [19]

Sakamoto

[11] Patent Number: 5,083,139

[45] Date of Patent: Jan. 21, 1992

[54] THERMAL HEAD FORMED OF A FLAT CABLE ENCAPSULATED IN A SUPPORTING BODY

[75] Inventor: Mitsuo Sakamoto, Tokyo, Japan

[73] Assignee: Sony Corporation, Tokyo, Japan

[21] Appl. No.: 680,827

[22] Filed: Apr. 5, 1991

[30] Foreign Application Priority Data

Apr. 6, 1990 [JP] Japan ..... 2-37208[U]

[51] Int. Cl.[5] ..... B41J 2/395

[52] U.S. Cl. ..... 346/76 PH; 346/139 C

[58] Field of Search ..... 346/76 PH, 139 C, 153.1, 346/155, 162, 163, 164; 400/124, 121, 120

[56] References Cited

U.S. PATENT DOCUMENTS 4,630,074 12/1986 Horinouchi et al. ..... 346/76 PH
4,679,054 7/1987 Yoshikawa et al. ..... 346/76 PH
4,680,593 7/1987 Takeno et al. ..... 346/76 PH

FOREIGN PATENT DOCUMENTS 0054865 3/1985 Japan ..... 346/76 PH
0297157 12/1986 Japan ..... 346/76 PH

*Primary Examiner*—Benjamin R. Fuller
*Assistant Examiner*—Huan Tran
*Attorney, Agent, or Firm*—Hill, Van Santen, Steadman & Simpson

[57] ABSTRACT

The present invention enables simplification of the assembly of a thermal head capable of performing printing at a high density and with a high resolution. A stable support of electrodes is also provided, along with an improvement in characteristics. The thermal head includes a parallel flat cable composed of a plurality of electrode wires aligned in flat fashion in a polymer insulating coating. A supporting body is made of a bonding agent which is abundant in rigidity and which encapsulates the polymer insulating coating, or encapsulates the electrode wires with a portion of the polymer insulating coating removed, at an end portion of the parallel flat cable at a printing plane.

8 Claims, 4 Drawing Sheets

THERMAL HEAD FORMED OF A FLAT CABLE ENCAPSULATED IN A SUPPORTING BODY

BACKGROUND OF THE INVENTION

1. Field of the Invention

The present invention generally relates to thermal heads and, more particularly, is directed to a thermal head which is used as a printer for computers, personal computers and so on or as a recording means for facsimile equipment or the like.

2. Description of the Prior Art

Recently, as the performance of computers, personal computers and so on are enhanced more and more, it is desired that the performance of a printer which serves as a recording apparatus therefor is also enhanced, which naturally requires high speed and high density printing.

As a recording system of such a printer, a conductive thermal printing system is known. According to this conductive thermal printing system, the printing is carried out by directly heating an ink layer of an ink ribbon or the like by the conduction of the ink ribbon by means of, for example, conductive electrodes. This printing system has an excellent printing speed and for this reason, the development of the conductive thermal printing system is remarkable.

Such a conductive thermal printing system will be described with reference to FIG. 1. FIG. 1 illustrates a perspective view of a main portion of an example of a conventional thermal head.

In FIG. 1, reference numeral 21 designates an insulating substrate made of, for example, ceramics. A conductive thin film made of aluminum (Al) or the like is deposited on the entire surface of a major surface 21A thereof by some suitable process such as a vapor deposition, a sputtering process, a screen printing process or the like. Then a pattern etching is performed, for example, a patterning is performed in a range of from an end face 21B to an end face 21C of, for example, an insulating substrate 21 in a straight line fashion to thereby form a wiring pattern 24. This wiring pattern 24 serves as a conductive thermal electrode 23 to construct a thermal head 10.

The conductive thermal electrode 23 formed by the above-mentioned method has a cross section such that an aspect ratio thereof i.e. a ratio of the height of the wiring pattern 24 relative to its width is less than 1. For this reason, in printing, the conductive thermal electrode 23 is inclined so as to make the aspect ratio close to 1. FIG. 2 is a schematic cross-sectional side view illustrating the recording condition of the conventional thermal head 10.

As shown in FIG. 2, if the conductive thermal electrode 23 is conducted under the condition such that one end face of the conductive thermal electrode 23 i.e. a conductive thermal electrode end 23A is obliquely brought in contact, for example, with an ink ribbon 28, the ink layer of the ink ribbon 28 is heated and melted at its portion where the ink ribbon 28 is brought in contact with the conductive thermal electrode end 23A. The thus heated and melted ink layer is exuded onto a printing paper urged against the ink ribbon 28 by a platen or the like, the printing thus being made.

In the above printing method, however, in order to prevent the area in which the insulating substrate 21 contacts with the ink ribbon 28 from increasing because the thermal head 10 is worn, the insulating substrate 21 must be cut-away as shown by a broken line in FIG. 2, which makes the configuration of the thermal head 10 complicated. Such a complicated thermal head 10 cannot be produced efficiently.

The wiring pattern 24 of high density must have a width of, for example, 60 μm, a height of 60 μm and a pitch of 125 μm in order to obtain a printing of high density and high resolution, both of which are recent demands. Such a high density wiring pattern cannot be made without difficulty, and lead wires cannot be led out without difficulty from each of the conductive thermal electrodes 23 formed of the high density wiring pattern 24, which hinders the thermal head from being produced efficiently. Furthermore, defective wiring brings about an inferior thermal head, which unavoidably lowers productivity.

To solve the above-mentioned problems, such a thermal head structure is proposed, in which lead wires, serving as conductive thermal electrodes, are embedded in grooves formed on a substrate by a mechanical cutting process, a laser machining process or the like. However, the mechanical machining process of high density is difficult to perform, and this thermal head structure causes the number of assembly processes to increase, which as a result hinders the thermal head from being produced efficiently.

Furthermore, such a proposal for the thermal head structure is also made, in which a flexible printed circuit board (i.e. FPC) is used and conductive portions interconnected within this FPC are used as conductive thermal electrodes without modifications thereof. However, because the base material of the FPC has a poor wearproof property, the thermal head characteristic is deteriorated. Also, since the conductive portions constructing the electrodes are made by printing techniques, such as a printing process or the pattern etching process of metal thin film or the like, the aspect ratio of the cross section of the conductive portion i.e. electrode becomes comparatively small. From this standpoint, it is difficult to obtain a printing of high density and high resolution.

A further proposal provides a thermal head structure such that parallel flat wires in which fine conductive wires, each having a diameter of about 60 to 80 μm, are aligned in the electrically isolated condition within a polymer resin. These are used as a conductive thermal electrode to form a thermal head. In this case, in order to hold the flexible parallel flat wires without being displaced on a printing surface, the assembly work thereof becomes complicated.

OBJECTS AND SUMMARY OF THE INVENTION

Accordingly, it is an object of the present invention to provide an improved thermal head which can substantially eliminate the aforenoted shortcomings and disadvantages encountered with the prior art.

More specifically, it is an object of the present invention to provide a thermal head whose assembly process can be simplified.

It is another object of the present invention to provide a thermal head which can be operated more efficiently.

It is still another object of the present invention to provide a thermal head which can provide a printing of high resolution.

It is a further object of the present invention to provide a thermal head which can improve its characteristics.

It is a further object of the present invention to provide a thermal head whose designing can be simplified.

It is yet a further object of the present invention to provide a thermal head which can be produced more efficiently.

It is yet a further object of the present invention to provide a thermal head which can be made inexpensive.

It is still a further object of the present invention to provide a thermal head whose service life can be extended.

According to a first aspect of the present invention, a thermal head including a parallel flat cable composed of a plurality of electrode wires aligned flat in a polymer insulating coating is comprised of a supporting body made of a bonding agent and abundant in rigidity, and which encapsulates, the polymer insulating coating or encapsulates the electrode wires with a portion of the polymer insulating coating removed at, an end portion of the parallel flat cable at a printing plane.

In accordance with a second aspect of the present invention, a thermal head is comprised of a plurality of electrode wires aligned in a ceramic supporting body, wherein end surfaces of the electrode wires at one end are exposed on a printing plane of the ceramic supporting body, the other end portions of the electrode wires are exposed to the outside in a recess formed in a rear portion of the ceramic supporting body, and the electrode wires are electrically connected to other sections in the recess.

The above, and other objects, features and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

Figure 1:
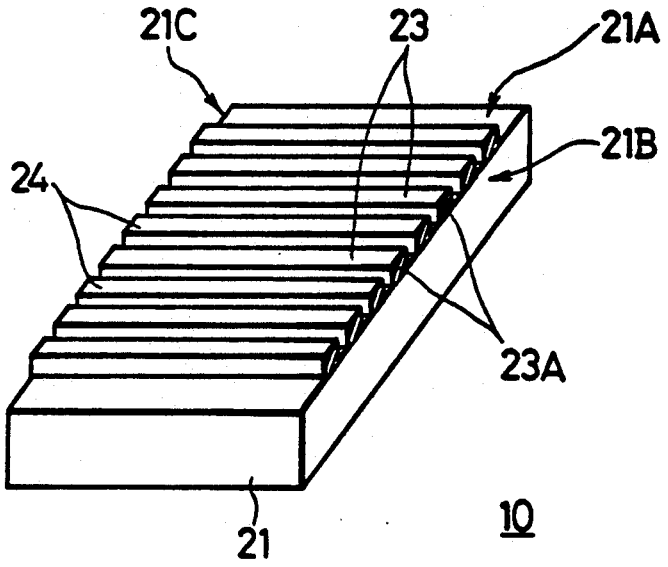
FIG. 1 (PRIOR ART)
FIG. 1 is a perspective view of a main portion of a thermal head according to the prior art.
Figure 2:
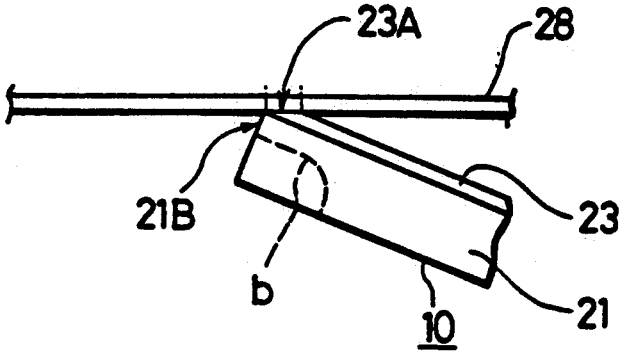
FIG. 2 (PRIOR ART)
FIG. 2 is a side view of the main portion of the thermal head of FIG. 1 and to which references will be made in explaining the recording condition of such a thermal head.
Figure 3:
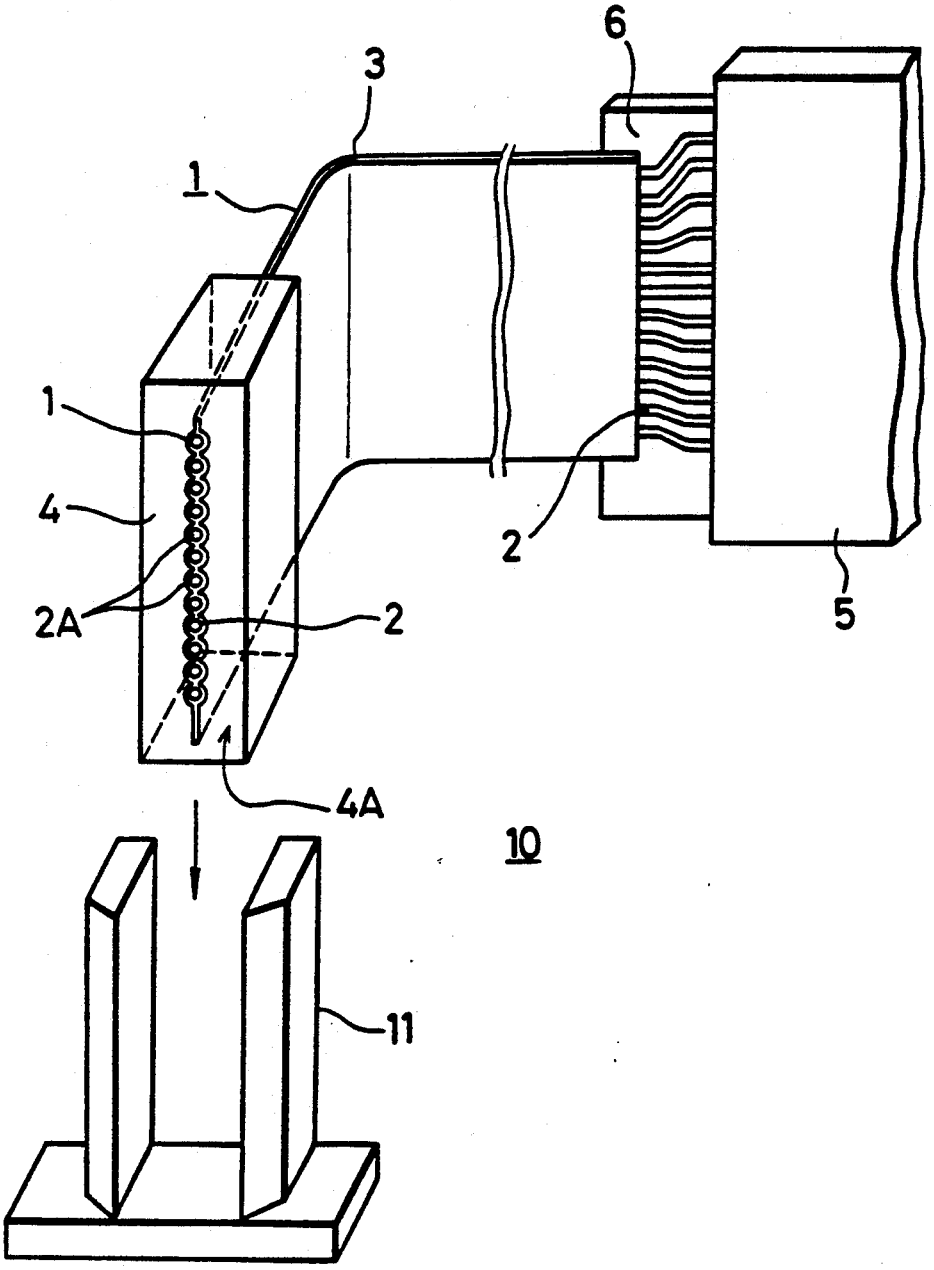
FIG. 3 is schematic perspective view illustrating a first embodiment of the thermal head according to the present invention in an enlarged scale.

Embodiments of the thermal head 10 according to the present invention will hereinafter be described with reference to FIGS. 3 to 5.

A first embodiment of the thermal head 10 according to the present invention will be described below and in this embodiment, the present invention is applied to a conductive thermal head. As shown in FIG. 3, conductors, each having a diameter of, for example, 60 μm and made of material having a large elasticity such as W (Tungsten), Mo (Molybdenum), Ni (Nickel) and so on, are aligned at a spacing of, for example, 125 μm as electrode wires 2 in a planar fashion. They are covered by a polymer insulating coating 3 which has an excellent insulating property and heat resistance. Further, end portions 2A serving as electrode terminals on one side of the respective electrode wires 2 are covered with an inorganic adhesive material having a low melting temperature and an insulating property, such as water glass, aronceramic or the like, in a manner that they are encapsulated thereby and solidified by a drying-process or the like, to thus mold a rigid supporting body 4. That is, the parallel flat cable 1 covered with the polymer insulating coating 3 is formed while the end portion 2A thereof is supported by the rigid supporting body 4. In this case, for example, the front end surface of the supporting body 4 is used as a printing plane 4A to which the end faces of the end portions 2A of the respective electrode wires 2 are faced. When this thermal head 10 is assembled into a printer or other recording apparatus, the supporting body 4 is inserted into a holder 11 which is disposed on a fixed portion so as to sandwich the supporting body 4, and are secured thereto by a bonding agent.

On the other hand, the other end of the parallel flat cable 1, for example, has the electrode wires 2 exposed and connected to a flexible printed circuit board (FPC) 5 through an interface board 6, if necessary, whereby lead wires are led out to complete the thermal head 10.

In this structure, the respective electrode wires 2 are applied with a required current, a printing paper is urged against one side end surface 4A of the supporting body 4, that is, a printing plane through an ink ribbon, not shown, by means of a platen or the like, and the ink ribbon is heated and melted by the conduction, thereby performing printing on the paper.

When the parallel flat cable 1 is connected to the flexible printed circuit board 5 through the interface board 6 as described above, if the end portion of the electrode wire 2 is exposed on the interface board 6 and the pitch is widened or the like, then it will become possible to reliably connect the parallel flat cable 1 to the flexible printed circuit board 5.

A second embodiment of the present invention will now be described with reference to FIG. 4 wherein the parallel flat cable 1 is connected to the flexible printed circuit board 5 without the interface board 6. FIG. 4 is a schematic perspective view illustrating the second embodiment of the thermal head according to the invention in an enlarged scale. In FIG. 4, like parts corresponding to those of FIG. 3 are marked with the same references and therefore need not be described in detail.

Figure 4:
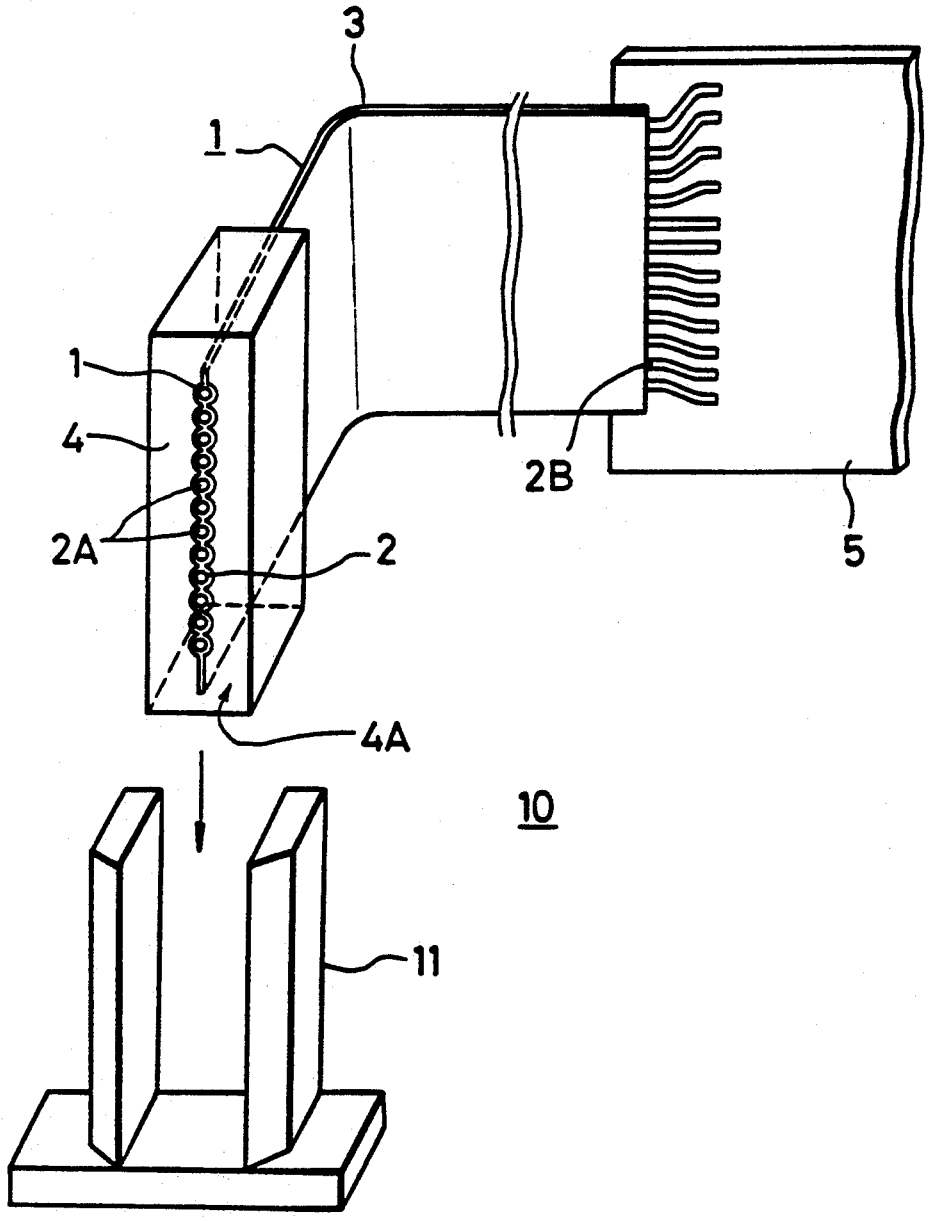
FIG. 4 is a schematic perspective view illustrating a second embodiment of the thermal head according to the present invention in an enlarged scale.
Figure 5:
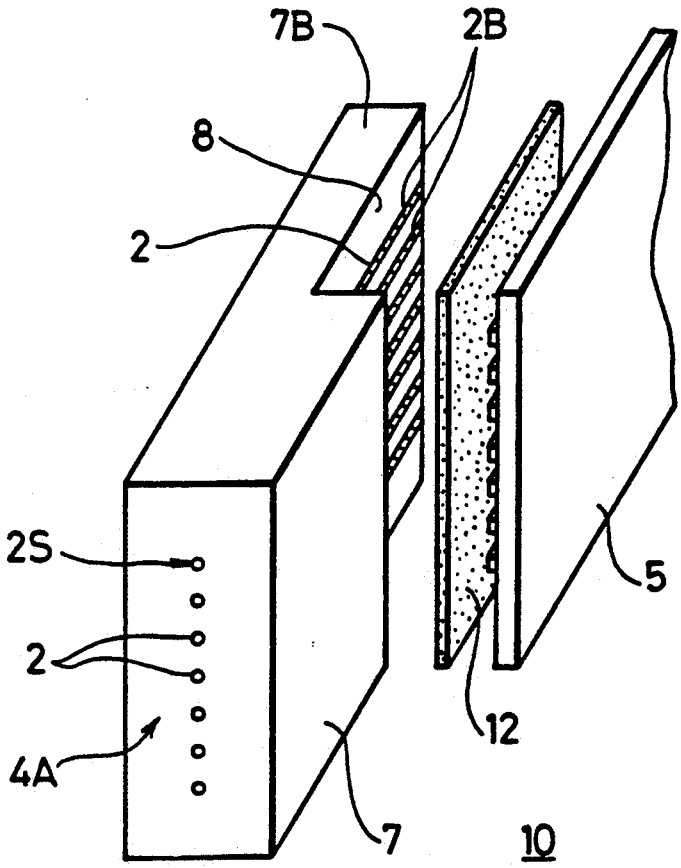
FIG. 5 is perspective view illustrating a third embodiment of the thermal head according to the present invention in an enlarged scale.

As shown in FIG. 4, the end portion 2A of the parallel flat cable 1 is constructed in a manner such that is is covered with the supporting body 4 made of an organic bonding agent, by the same materials and manufacturing method as explained with reference to FIG. 3. In the other end portion of the parallel flat cable 1, the other end portions 2B of the electrode wires 2 are exposed to the outside, and are directly connected to the flexible printed circuit board 5 from which lead wires are led out, thus to complete the thermal head 10.

It has been confirmed that the above-mentioned organic bonding agent may be epoxy resin, Araldite AZ15/HZ15 (trade name and manufactured by Chiba Geigy Japan Ltd.), ARALDITE XD911 (trade name and manufactured by Chiba Geigy Japan Ltd.), CEMEDINE EP580 (trade name and manufactured by Cemedine Co., Ltd.) or the like with enough rigidity being maintained.

While in the above-mentioned first and second embodiments the end portion of the parallel flat cable 1 is molded in a manner that it is encapsulated by an inorganic adhesive material forming the supporting body 4 over the polymer insulating coating 3, in this end portion, the coating of the polymer insulating coating 3 may be avoided or the polymer insulating coating 3 may be removed to thereby expose these portions of the electrode wires 2. Under this exposed state, the electrode wires 2 may be encapsulated by an adhesive material and dried and solidified or cured by the heating-process, resulting in the supporting body 4 being molded.

A third embodiment of the thermal head 10 according to the present invention will be described in detail with reference to FIG. 5. FIG. 5 is a schematic perspective view illustrating the third embodiment of the thermal head 10 in an enlarged scale. In FIG. 5, like parts corresponding to those of FIG. 3 are marked with the same references and therefore need not be described in detail.

Also in this embodiment, the present invention is applied to the conductive thermal head. Apertures are formed through a ceramic supporting body 7 of, for example, a plate shape by, for example, a light patterning-process, and then the electrode wires 2 each having a diameter of approximately 60 μm made of W, Mo, Ni or the like are aligned at a spacing of, for example, about 125 μm in this ceramic supporting body 7 by means of a metal sealing or the like in a planar fashion. Then, an end face 2S at one end of each of the electrode wires 2 is opposed to a printing face 4A of the ceramic supporting body 7 such that this end surface 2S is urged against the printing paper (not shown) through the ink ribbon or the like.

In the end portion of the ceramic supporting body 7 opposite to the printing face 4A i.e. a rear portion 7B, a recess 8 is formed through the ceramic supporting body 7 by a mechanical cutting process and so on or in the ceramic molding process so as to expose the other end portions 2B of the electrode wires 2. Then, the electrode wires 2 exposed in this recess 8 are connected to the flexible printed circuit board 5 through, for example, an anisotropic conductive layer 12 or the like. This anisotropic conductive layer 12 is composed of a non-conductive plane layer made of, for example, a bonding agent and particles of a conductive material dispersed therein, and presents no conductivity in the direction along its major surface but presents conductivity only in the direction perpendicular to the major surface. By contacting the flexible printed circuit board 5 with the electrode wires 2 through such an anisotropic conductive layer 12 or the like and heating the same at a predetermined temperature for adhesion, an electric connection is established between the electrode wires 2 and the flexible printed circuit board 5, and from here read-out wires are led out to oomplete the thermal head 10.

Although not shown, also in this embodiment, when this thermal head 10 is incorporated in a printer or other recording apparatus, the ceramic supporting body 7 is supported in a nipping manner. For example, it is inserted into a holder or the like arranged on a fixed location of a recording apparatus and is secured by a bonding agent.

In such a structure, the respective electrode wires 2 are applied with a required current, one lateral end surface of the ceramic supporting body 4 or the printing plane 4A is pressed against paper through an ink ribbon, not shown, by means of a platen or the like, and the ink ribbon is heated and melted by conduction, thereby making it possible to perform a printing on the paper.

While the present invention is applied to a conductive thermal head in the above-mentioned embodiments, the present invention can be applied to thermal heads for other apparatus such as an electrostatic plotter.

As described above, the thermal head 10 according to the present invention comprises the parallel flat cable 1 formed to serve as the electrode wires 2, thereby making it possible to simplify a position setting of the electrode wires 2, that is, an assembly process and improve the working efficiency. Also, since the lines or the electrode wires 2 in the parallel flat cable 1 may have the diameter ranging from 60 to 80 μm, if they are used as an electrode end surface of the thermal head, it is possible to make a shape of printed dots circular and realize a high density, whereby a printing in a high resolution can be provided. It is also possible to securely and easily form lead-out wires therefrom, which leads to an improvement in characteristics.

Further, the shape of this parallel flat cable 1, such as the thickness, width and so on is far smaller than electrodes of conventionally used conductive thermal heads or the like formed of a flexible printed circuit board and so on, so that the thermal head can be reduced in size, which may provide a larger freedom in a positional structure of the thermal head in an apparatus such as a printer or the like. This leads to achieving a simplification of the assembly, an improvement in the productivity, and a cost reduction.

Furthermore, the other thermal head according to the present invention, similar to the above-mentioned thermal head of the present invention, can achieve a simplification of the assembly process of the position setting of the electrode wires to thereby improve the working efficiency, provide a highly dense printing and a printing in a high resolution, and securely and easily forming lead-out wires to improve the characteristics. Also, as compared with conventional thermal heads using flexible printed circuit board, it is possible to reduce the size and achieve an easy design and assembly to improve the productivity and reduce the cost.

Also, since the printing plane is composed of the ceramic supporting body, it is excellent in abrasion resistance and heat resistance, thereby providing a long life.

Having described preferred embodiments of the invention with reference to the accompanying drawings, it is to be understood that the invention is not limited to those precise embodiments of the invention and that various changes and modifications thereof could be effected by one skilled in the art without departing from the spirit or scope of the novel concepts of the invention as defined in the appended claims.

I claim as my invention:

1. A thermal head, comprising:

a parallel flat cable formed of a plurality of parallel electrode wires aligned in a polymer insulating coating; and a rigid supporting body comprising a bonding agent which is encapsulated over the polymer insulating coating at an end portion of the parallel flat cable, ends of said electrode wires being provided at an end face of the supporting body forming a printing plane.

2. A thermal head according to claim 1 wherein an end of the parallel flat cable opposite the end portion encapsulated by the supporting body being mounted to an interface board which in turn connects to a flexible printed circuit board, the electrode wires of the flat cable being electrically connected via the interface board to the flexible printed circuit board.

3. A thermal head according to claim 1 wherein ends of the electrode wires opposite the ends encapsulated in the supporting body being directly electrically connected to a flexible printed circuit board.

4. A thermal head, comprising:

a parallel flat cable formed of a plurality of parallel electrode wires aligned in a polymer insulating coating;

the polymer insulating coating being removed from the electrode wires at an end portion thereof; and a rigid supporting body comprising a bonding agent which encapsulates at least said electrode wires where the polymer insulating coating is removed, ends of the supporting wires being provided in line at an end face of the supporting body at a printing plane.

5. A thermal head according to claim 4 wherein an end of the parallel flat cable opposite the end portion encapsulated by the supporting body being mounted to an interface board which in turn connects to a flexible printed circuit board, the electrode wires of the flat cable being electrically connected via the interface board to the flexible printed circuit board.

6. A thermal head according to claim 4 wherein ends of the electrode wires opposite the ends encapsulated in the supporting body being directly electrically connected to a flexible printed circuit board.

7. A thermal head, comprising:

a supporting body having a plurality of electrode wires aligned therein and wherein end faces of said electrode wires at one end are exposed at an end face of the supporting body forming a printing plane;

end portions of said electrode wires opposite side end faces at the printing plane being exposed to the outside by a recess formed at a rear portion of said supporting body; and means for connecting the electrode wires at said recess to a circuit board; and said means for connecting comprising an anisotropic conductive layer laid over the electrode wires in said recess, and a printed circuit board being laid on top of the anisotropic conductive layer, the anisotropic conductive layer electrically connecting in a vertical direction the respective electrode wires to respective conductors of the circuit board.

8. A thermal head according to claim 7 wherein the circuit board comprises a flexible printed circuit board received in said recess.

* * * * *